US005339471A

United States Patent [19]

Lanzara

[11] Patent Number: 5,339,471

[45] Date of Patent: Aug. 23, 1994

[54] BED FOR SUPPORTING A PRONE USER WITH A LARGE ABDOMEN

[76] Inventor: Ronald F. Lanzara, 340 Broad St., Nashua, N.H. 03063

[21] Appl. No.: 1,655

[22] Filed: Jan. 7, 1993

[51] Int. Cl.[5] ..... A47C 17/66

[52] U.S. Cl. ..... 5/110; 5/600; 5/930

[58] Field of Search ..... 5/600, 110–114, 5/631, 930

[56] References Cited

U.S. PATENT DOCUMENTS

| | | | |
|---|---|---|---|
| 2,089,854 | 8/1937 | Pellegrini | 5/930 |
| 3,464,069 | 9/1969 | Bien | 5/930 |
| 4,054,960 | 10/1977 | Pettit et al. | 5/631 |
| 4,508,384 | 4/1985 | Castelot et al. | 5/930 |
| 4,921,301 | 5/1990 | Haynes | 5/930 |
| 4,941,222 | 7/1990 | Prager | 5/111 |
| 4,973,034 | 11/1990 | Michele | 5/930 |
| 5,029,349 | 7/1991 | Hamilton | 5/631 |

*Primary Examiner*—Alexander Grosz

*Attorney, Agent, or Firm*—Hayes, Soloway, Hennessey, Grossman & Hage

[57] ABSTRACT

A resting bed for supporting a user, having a large abdomen, in a prone position, said bed comprising a frame having generally parallel top rails supported above the floor, and including an upper trunk support sling and lower body support sling, each sling being slidably mounted on the said top rails, and spaced from one another so as to leave an open, unsupported space between them, for accommodating users of different height and abdomen size and shape.

5 Claims, 1 Drawing Sheet

BED FOR SUPPORTING A PRONE USER WITH A LARGE ABDOMEN

FIELD OF THE INVENTION

The present invention relates generally to bed assemblies. The invention has particular utility as bed assemblies for women in various stages of pregnancy, and which permits the users to recline on their stomachs, and will be described in connection with such utility, although other utilities are contemplated.

BACKGROUND OF THE INVENTION

The pregnant woman oftentimes finds it difficult, if not impossible, to recline in a prone position. This difficulty is enhanced as the term of pregnancy increases. Medical information indicates that it may be beneficial for a pregnant woman to recline in a prone position and from a practical aspect, the pregnant woman may wish to recline in a prone position to overcome the monotony or discomfort from sleeping or reclining in a supine position or on her side for the term of the pregnancy.

Oftentimes, the pregnant woman would have to resort to a makeshift situation of piling pillows on a bed in a particular manner in order to permit her to recline in the prone position. Outdoors, or at the beach, the pregnant woman would oftentimes have to mold the shape of the sand in order to accommodate her abdomen in order to recline in a prone position.

Various attempts had been directed towards easing this discomfort in providing a pregnant woman with the ability to recline on her abdomen.

U.S. Pat. No. 4,021,872 to Powell discloses a maternity mattress which contains a depression to accommodate a pregnant woman's abdomen when she reclines in a prone position. Additionally, U.S. Pat. No. 3,378,862 to Skinner discloses a maternity mattress which would accommodate the abdomen of a pregnant woman. These devices are cumbersome and must be used on a support surface or the floor and limit the pregnant woman to a prone position.

U.S. Pat. No. 4,508,384 to Castelot discloses a pregnancy supporting lounge chair. This lounge chair provides a frame and webbing strips to accommodate a person in the normal fashion, and is adjustable to provide for a stretch band for use by a pregnant woman utilizing the chair in a prone position, the lateral stretch band accommodating the pregnant woman's abdomen.

The foregoing discussion of the prior art is in large part taken from U.S. Pat. No. 5,029,349 to Hamilton who discloses a multi-purpose chair assembly adaptable for use by a pregnant woman, and which allows for the adjustability of the chair to accommodate the user's abdomen and breasts comfortably during the term of pregnancy. Hamilton proposes a multi-part support frame having a plurality of support legs, and including an adjustable support cloth or fabric, unrollable from a rotatable drum or dowel to provide the desired degree of slack between portions of the frame and support members. While the pregnancy supporting chair assembly disclosed by Hamilton does provide for accommodating a pregnant woman's abdomen during various stages of pregnancy, the Hamilton patented device is not designed to accommodate users of different height.

OBJECTS OF THE INVENTION

It is therefore an object of the present invention to provide a resting bed for pregnant women which overcomes the aforesaid and other disadvantages of the prior art. A further object of the present invention is to provide a resting bed for pregnant women which is adjustable for various height women and also to accommodate different abdomen sizes as pregnancy progresses.

A still further and specific object of the present invention is to provide a resting bed for a pregnant woman which permits the user to lie face down in a prone position.

BRIEF DESCRIPTION OF THE DRAWINGS

These and other objects of the present invention will become clear from the following detailed description of the present invention taken in conjunction with the accompanying drawings wherein.

DETAILED DESCRIPTION OF THE INVENTION

Figure 1:
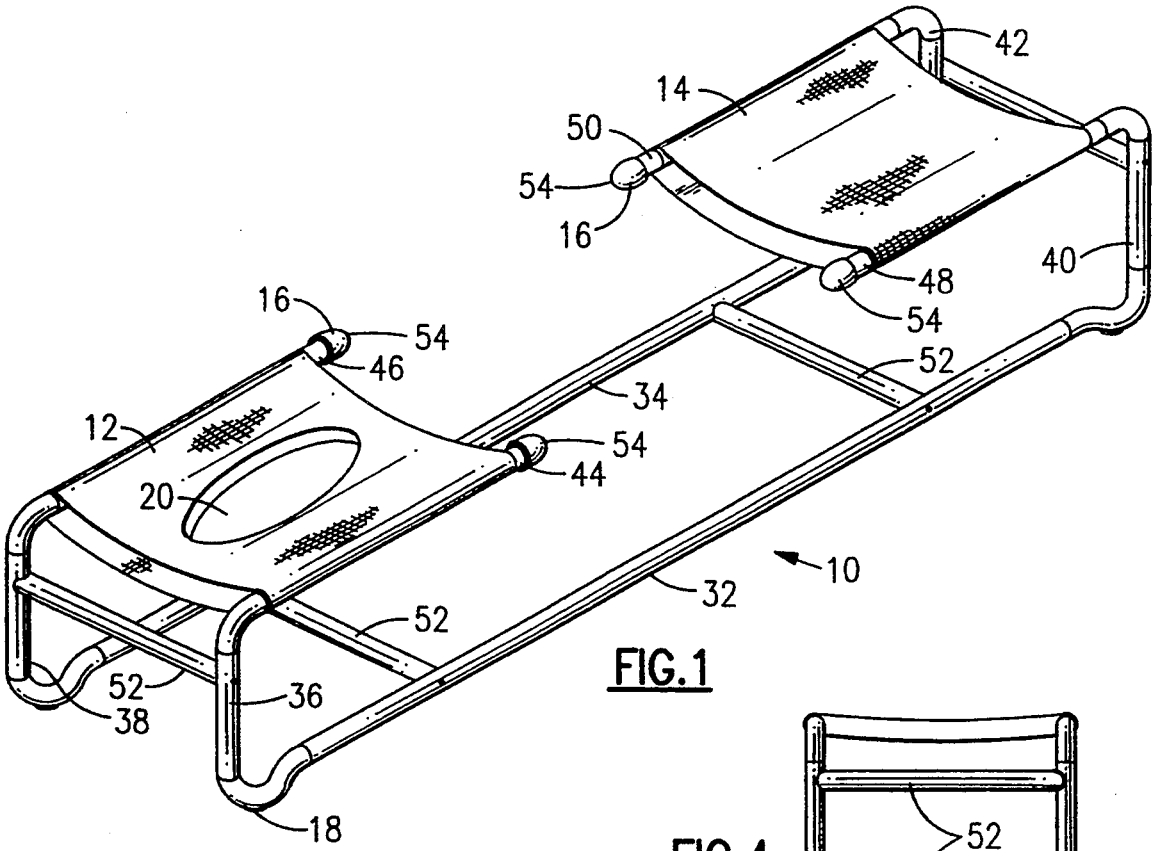
FIG. 1 a perspective view of a preferred form of resting bed made in accordance with the present invention.
Figure 4:
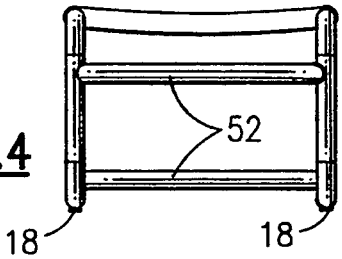
FIG. 4 is an end view of the resting bed of FIG. 1.
Figure 2:
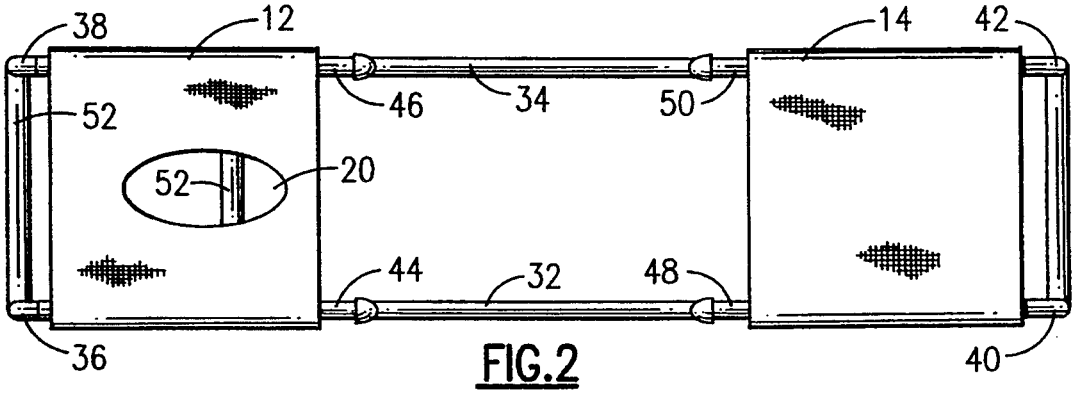
FIG. 2 is a top plan view of the resting bed of FIG. 1.
Figure 3:
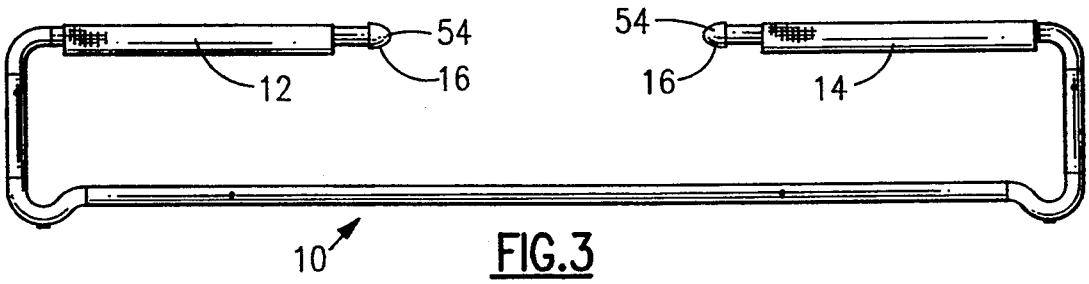
FIG. 3 is a side elevational view of the resting bed of FIG. 1.

Referring to the drawings, the resting bed made in accordance with the present invention comprises a tubular frame indicated generally at 10 comprising a pair of lower rails 32, 34, upright rails or legs 36, 38, 40 and 42 and top rails 44, 46, 48 and 50. A plurality of stabilizing rails 52 bridge the lower rails 32 and 34 and upright rails 36, 38, 40 and 42, respectively, so as to stabilize the frame 10 and maintain the lower, upright and top rail pairs in generally spaced, parallel relation to one another. Frame 10 preferably is formed of strong steel tubes, and is built low to the ground so as to permit easy mounting and dismounting.

An upper trunk canvas support sling sleeve 12 is slidably mounted on frame 10 on top rails 44 and 46, for supporting the shoulders and chest of the user. A lower body canvas support sling sleeve 14 is slidably mounted on top rails 48 and 50, for supporting the pelvis and legs of the user. Canvas sleeve 12 and canvas sleeve 14 are both somewhat shorter than their respective support rails 44 and 46, and 48 and 50, respectively, so as to be slidably mounted thereon, i.e. so that the open i.e. unsupported space, between ends 16 may be adjusted to accommodate users of different height and also to accommodate changes in the size and shape of the user's abdomen as the user's pregnancy progresses. Rubber bumpers 54 are provided on the ends of rails 44, 46, 48 and 50 as stops for sleeves 12 and 14.

A cutout 20 in canvas sleeve 12 permits the user to lie face down, in a relaxed breathing position with her head facing forward in the normal anatomical position for the head. This permits a pregnant woman to relax in a prone position, taking stress off of her limbs, and alleviate gravity caused stress throughout the gestation period. The physiological advantages permitted by the present invention are believed to be considerable, and reduce significantly stress on musculoskeletal body structures, and provide a physiological comfort for pregnant women not heretofore achievable.

Completing the invention are four rubber skid pads 18 located at the four corners of the frame 10.

While the invention has been described for use by pregnant women, the invention also may advantageously be used by non-pregnant males and females with large pendulous abdomens, to lie down in the prone position for comfort and stress relief or reduction.

What is claimed is:

1. A resting bed for supporting a user, having a large abdomen, in a prone position, said bed comprising a frame having generally parallel top rails supported above the floor, and including an upper trunk support sling and lower body support sling, each sling being slidably mounted on the said top rails, and spaced from one another so as to leave an open, unsupported space between them, for accommodating users of different height and abdomen size and shape.

2. A resting bed according to claim 1, and including a cutout formed in the upper body support sling for accommodating the face of the user, and for permitting the user to breathe.

3. A resting bed according to claim 1, wherein said frame is formed of steel tubes.

4. A resting bed according to claim 1, wherein said upper trunk support sling and said lower body support sling comprise canvas sleeves.

5. A resting bed according to claim 1, wherein said frame includes a plurality of stabilizing rails for maintaining the top rails in spaced, generally parallel relation to one another.

* * * * *